United States Patent [19]

Daly

[11] 4,452,323

[45] Jun. 5, 1984

[54] VALVE ASSEMBLY FOR DRILL BIT LUBRICATION SYSTEM

[75] Inventor: Jeffery E. Daly, Houston, Tex.

[73] Assignee: Reed Rock Bit Company, Houston, Tex.

[21] Appl. No.: 338,768

[22] Filed: Jan. 11, 1982

[51] Int. Cl.[3] ..... E21B 10/22

[52] U.S. Cl. ..... 175/229; 384/93

[58] Field of Search ..... 175/227, 228, 229; 308/8.2; 137/512, 512.4, 523, 855

[56] References Cited

U.S. PATENT DOCUMENTS

| | | | |
|---|---|---|---|
| 893,852 | 7/1908 | Leyner | 137/855 |
| 1,306,391 | 6/1919 | Romanoff | 137/527 |
| 3,303,898 | 2/1967 | Bercasu | 175/228 |
| 3,866,695 | 2/1975 | Jackson | 175/228 |
| 4,284,151 | 8/1981 | Levefelt | 308/8.2 |

FOREIGN PATENT DOCUMENTS

| | | | |
|---|---|---|---|
| 131193 | 1/1951 | Sweden | 137/512.4 |

*Primary Examiner*—Ramon S. Britts
*Assistant Examiner*—Joseph Falk
*Attorney, Agent, or Firm*—Michael J. Caddell

[57] ABSTRACT

A valve system is disclosed for use in the lubrication passages of a rolling cutter drill bit, which valve assembly utilizes one or more reed valves to maintain flow of lubricant in a desirable direction.

5 Claims, 7 Drawing Figures

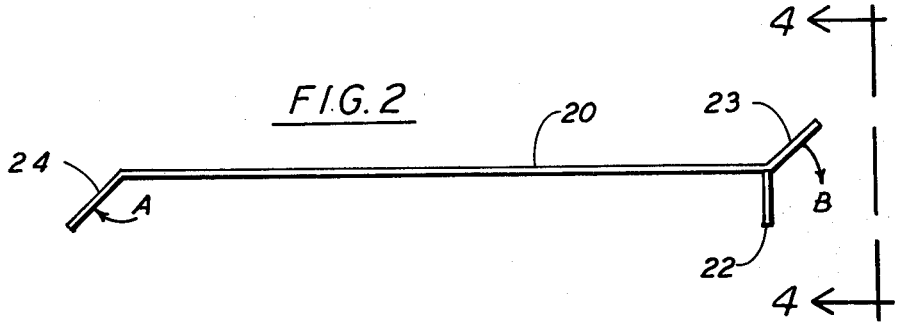
FIG. 2
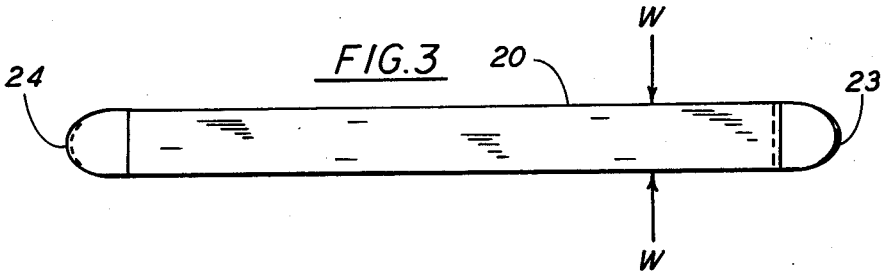
FIG. 3
FIG. 4
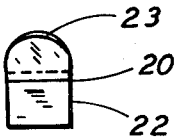
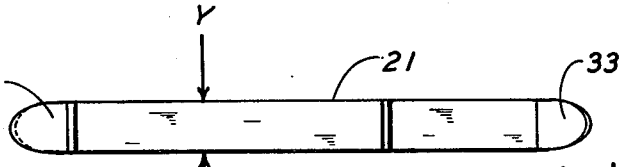
FIG. 5
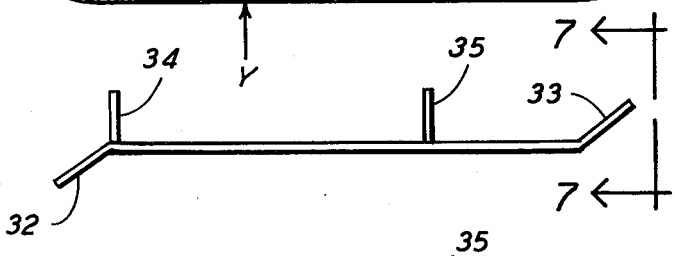
FIG. 6
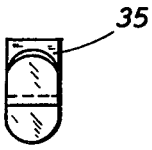
FIG. 7

VALVE ASSEMBLY FOR DRILL BIT LUBRICATION SYSTEM

BACKGROUND OF THE INVENTION

The present invention relates generally to rolling cutter drill bits and other drill bits utilizing internal lubricating systems. More particularly, the invention involves a valving system for use in the lubricant passages located internally in such drill bits. In conventional rolling cutter drill bit lubrication systems, such as that disclosed in U.S. Pat. No. 3,923,348 granted to James A. Peck, filed Mar. 13, 1974, for "FRICTION BEARING", which patent is herein incorporated by reference in its entirety, the lubricant passages comprise a grease reservoir chamber connected by internal bore passages to the bearing areas of the bearing journal. Generally, there is no valving in these internal bore passages because of the inaccessibility of the passages and the difficulty of forming additional passages to receive the valving and to provide two-way flow communication. Thus, in the conventional lubricated bits, desirable circulation of lubricant therein is achieved, if at all, only by accident or fortuitously.

The present invention provides valving for conventional lubricant passages in a lubricated drill bit, which valving converts the passages into two-way flow and provides desirable flow paths for the lubricant in the bit.

BRIEF DESCRIPTION OF THE DRAWINGS

FIGS. 2 through 4 are different views of one reed valve of this invention.

FIGS. 5 through 7 are different views of the second reed valve of the invention.

DESCRIPTION OF THE PREFERRED EMBODIMENTS

Figure 1:
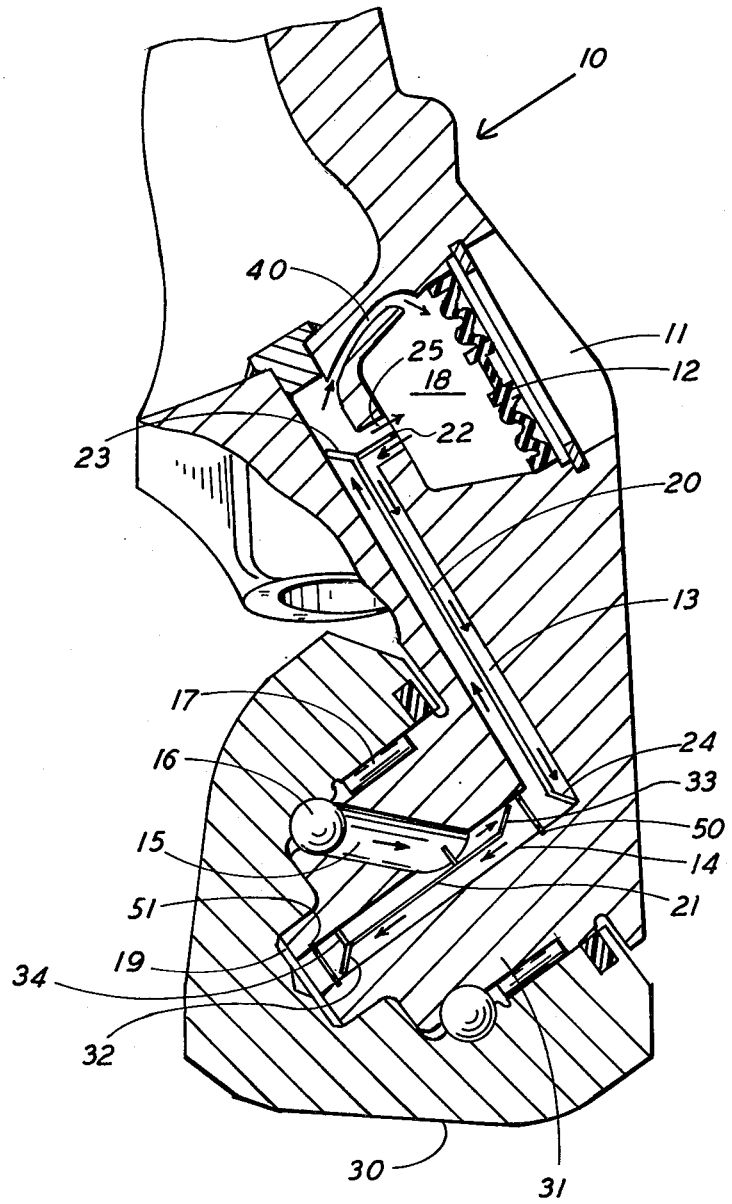
FIG. 1 is a cross-sectional side view of a lug assembly of a rolling cutter drill bit.

Referring now to FIG. 1, a lug assembly 10 is shown having a lubricant cavity 11 sealed by a flexible diaphragm 12, a lug lubricant passsage 13, a journal lubricant passage 14, and a bearing lubricant passage 15. The lubricant cavity 12 and the passages 13, 14 and 15 comprise the lubricant supply system to the bearings 16 and 17 of the bit. Normally, a hard oil or grease lubricant is located in the enclosed chamber area 18 of cavity 11 and fills the passages 13, 14 and 15. Normally, there is no means for circulating the lubricant from the storage area 18 into the bearing area of the journal. In addition to the ball bearings 16 and the friction or roller bearings 17, the drill bit has a thrust bearing 19 which also beneficially utilizes a lubricant supply. The present invention comprises a reed valve assembly 20 placed in lug passage 13 to separate the single passage into a dual flow passage for circulating the lubricant from cavity 18 into the journal area of the bit. In addition a second reed valve 21 may be placed in journal passage 14 to further divide it into a dual flow passage and provide increased circulation of the lubricant in the bearing area. FIG. 2 is a blown-up side view of reed valve 20. The valve has a stop member 22 projecting at a right angle from the main body of valve 20. A pair of oblique valving tangs 23 and 24 project from each end of body 20 in opposing directions. FIG. 3 is a view of valve 20 taken at 90 degrees from the view of FIG. 2. In this view, the arcuate configuration of tangs 23 and 24 can be seen. FIG. 4 is an end view of valve 20 taken at line 4—4 of FIG. 2.

FIG. 4 also illustrates the arcuate configuration of tang 23 and the rectangular configuration of stop tang 22. The reed valve 20 is sized in width indicated at dimension arrows W to correspond substantially to the diameter of the cylindrical lug bore 13 in which the reed valve is located. Thus, because the width W is equivalent to the diameter of bore 20, the reed valve serves to divide the bore into two separate flow passages.

The tang members 23 and 24 serve to form single-flow checkvalves in the relative passages formed by member 20. The tang 24 is arranged to provide flow from right to left below valve 20 in FIG. 2, and to prevent flow from left to right in the same area. On the other hand, tang 23 is arranged to allow flow above reed 20 from left to right and to prevent flow in the opposite direction above valve 20. The operation of the arcuate tangs is in the manner of a reed valve or flapper valve. The arcuate ends of tangs 23 and 24 are curved to snugly fit in the curvature of bore 13, thus sealing the bore against flow of fluids thereby in one direction. The flexible nature of reed 20 allows tangs 23 and 24 to flex upwardly toward the center of the bore to allow thereby in one direction. Thus tangs 23 and 24 in conjunction with body 20 serve as backflow check valves in their respective channels formed by body 20. The direction of flex of tang 24 is indicated by arrow A, and the direction of flex of tang 23 is indicated by directional arrow B in FIG. 2. Also, the deflection of the tangs is selected to project the curved end portions into close-fitting proximity to the interior walls of bore 13 such that in their normal resting position, they are in like contact therewith. The material of reed valve 20 is selected from a relatively flexible substance such as steel, copper, brass, bronze or one of the many flexible plastics.

Referring again to FIG. 1, the reed valve 20 is inserted in the lug lubricant passage 13 such that tang 24 is near the lower end thereof, but has a sufficient amount of room to flex towards the center line of bore 13 to allow fluid to bypass therearound. Likewise, valve tang 23 is located at the upper end of passage 13 near the access passage 25 which communicates reservoir 18 with passage 13. Right angular tab 22 is located and projects into access hole 25 and is centered therein. Preferably, tab 22 is of substantially identical width to the internal diameter of hole 25, thereby maintaining it centered therein. During operation of the rock drilling bit, reservoir 18 and passages 13, 14 and 15 will be filled with a lubricant such as a solid or semi-solid grease. As the bit rotates in the borehole, axial fluctuations of the cutter 30 on the bearing journal 31 causes pressure fluctuations of the lubricant within the internal passages. As the cutter moves downward off of the journal a slight distance in response to a downward tension force thereon, a vacuum is created in the bore passages and lubricant is drawn out of reservoir 18. Then, as the thrust forces move cutter 30 back tightly onto journal 31, a positive pressure is created in the passages and lubricant is forced back into reservoir 18. Because of the cyclic nature of this movement between the cutter and the journal, a continuous pumping operation is created within the lubricant passages of the drill bit. Unfortunately, the lubricant in the passages does not circulate, but merely moves back and forth in the same general area in which it is always located, and the lubricant in the bearing areas is never changed but becomes worn and broken down and leads to early bearing failure.

Also, heat buildup in the bearing area tends to degrade the lubricant in that proximity thereto until the lubricant loses its lubricating properties and bearing failure is accelerated. By utilizing the reed valve assembly of this invention, the lubricant passage 13 is divided into a dual flow channel and the interaction of reed valves 23 and 24 provides a checkvalve operation which creates a one-way flow in a cycle within passage 13. Thus it can be seen that as the cutter 30 moves downward on journal 31 creating the vacuum in passage 14, this vacuum tends to draw extra lubricant through bore 13 from reservoir 18. This vacuum serves to flex tang 24 downward thereby opening the upper chanel of bore 13 for downward flow therethrough. The same vacuum tends to pull tang 23 downward into tight engagement with the bottom wall of bore 13, thereby closing the lower channel to downward flow. As the cutter is pushed back onto journal 31 and creates a positive pressure in bore 14, the positive pressure forces tang 24 downward to seal against the wall of bore 13, and the positive pressure then moves upward in the lower channel of bore 13 flexing tang 23 upward into an open position and allowing recirculation of lubricant back through hole 25 into recess 18. Thus, the cyclic pressure and vacuum creation inside the cutter area of the bit tends to pump lubricant down the upper channel of bore 13 and up the lower channel of bore 13.

Although this circulating effect of reed valve 20 is beneficial and applies a fresh supply of grease into the journal area, it may be desirable to obtain even further circulation of the grease through the journal and directly to the bearing surfaces. This can be achieved by the addition of a second reed valve 21 in bore 14 to divide bore 14 into upper and lower flow channels to work in conjunction with the bifurcated passage 13. FIGS. 5 through 7 illustrate various views of reed valve 21. FIG. 5 is a top view of the valve 21 indicating the width at arrows Y—Y. Valve 21 comprises the body of width Y substantially identical to the inner diameter of journal bore 14. The valve has a pair of valving tangs 32 and 33 bent in opposing directions from body 21. Tangs 32 and 33 have arcuate end portions arranged to sealingly seat within the curvature of bore 14. A pair of stop members 34 and 35 project from one side of body 21 to engage in bearing passage 15 and to further provide a stop in the upper passage of bore 14 near the lowermost end of journal 31. Preferably, stop member 35 is a rectangular tang sized for close-fitting engagement in bearing passage 15. Tang 34 has an upper arcuate surface arranged for tight-sealing engagement in the upper curvature of bore 14. Thus the reed member 21 divides bore 14 into a dual passage channel to work in conjunction with reed 20 and provide a dual flow passage from the bearing area of the bit all the way to the lubricant reservoir.

In typical operation, reed member 21 is located in bore 14 in snug-fitting relationship therein, and the bore passages and reservoir are filled with a semi-solid lubricant. As the drill bit operates in the borehole, the cutter 30 will fluctuate on journal 31 as previously described. On its downward movement, cutter 30 will create a vacuum in passage 14, which will tend to suck lubricant down from the upper half of bore 13 past tab 24. This lubricant will be prevented by tang 33 from entering the upper half of channel 14, and therefore, the lubricant will move through the lower half of channel 14 below valve 21. The pressure in this channel will flex tab 32 towards the center line of bore 14, thereby opening this passage and allowing lubricant to flow into the bearing area 19. The tight-fitting engagement of tab 34 and the upper portion of bore 14 prevents backflow of lubricant into the top half of bore 14. Thus, the lubricant has been sucked into bearing area 19 by the downward movement of cutter 30 on journal 31. A short instant later when cutter 30 is pushed back onto journal 31, a positive pressure is created in bearing area 13, which positive pressure pushes tab 32 down into sealing engagement in bore 14. Tabs 32 and 34 then completely seal bore 14 against fluid flow back upward therethrough, and the lubricant is forced to travel around the end of the lug into the bearing area of ball bearings 16. This lubricant then moves down passage 15 into the upper passage of bore 14, whereupon it flexes tab 33 and moves into the return channel of bore 13. As the cutter begins to move back downwardly to create the vacuum again, the pressure will close tab 33 and open tab 32, thereby continuing the pumping cycle. Thus, as a result, lubricant is continuously pumped from reservoir 18 down the upper half of bore 13 past valve 24 and into the lower half of bore 14. The lubricant moves into bearing area 19 and around the space between cutter 30 and journal 31 and into the bearing area 16. From bearing area 16 it is pumped down passage 15 into the upper channel of bore 14 past tang valve 33 and into the lower half of bore 13. Thence, it progresses up bore 13 past tang valve 23 and back through passage 25 into the reservoir 18.

In addition to the lubrication system described above, an additional lubrication channel 40 may be provided near the very upper end of passage 13 to communicate with the very upper end of reservoir 18. In this instance a blockage of the upper portion of hole 25 may be provided so that returning lubrication is cycled from the bottom portion of bore 13 up through auxiliary bypass channel 40 into the top portion of reservoir 18. This prevents the recycling of used lubrication back around tab 22 and into the bore 13. Thus the used lubricant is circulated to the back side of the lubricant reservoir and clean lubricant is drawn into the system through hole 25.

Thus the present invention discloses means and apparatus for creating a dual channel lubricant circulation system in a conventional lubricated rolling cutter drill bit which system utilizes reed valving to provide any directional flow of lubricants through the circulatory cycle. The present invention is relatively uncomplicated and contains no moving parts other than the flexible tangs of the reed valves themselves. Likewise, the lubricant valving system can be utilized in existing drill bits with little or no modification. In addition to the valving system, a pair of circular retainer rings 50 and 51 can be provided in bore 14 to increse the efficiency of valve member 21 by limiting its sliding travel withing bore 14 responsive to the pressure fluctuations created by the cutter oscillations. It should also be noted that whereas each reed valve is disclosed in the preferred embodiment as having two opposed valving tangs; in another embodiment, a reed valve can be used having a single valving tang, located on only one side. While this embodiment would still provide circulation of lubricant, the flow rate would still provide circulation of lubricant, the flow rate would be about one-half the flow rate of the embodiment having two opposed valving tangs.

Although a specific preferred embodiment of the present invention has been described in the detailed description above, the description is not intended to limit the invention to the particular forms or embodiments disclosed therein, since they are to be recognized as illustrative rather than restrictive, and it will be obvious to those skilled in the art that the invention is not so limited. For example, the Reed valves illustrated could be inverted to reverse the flow of lubricant in the channels and obtain basically the same circulatory effect. Thus the invention is declared to cover all changes and modifications of the specific example of the invention herein disclosed for purposes of illustration, which do not constitute departures from the spirit and scope of the invention.

The embodiments of the invention in which an exclusive property or privilege is claimed are defined as follows:

1. A rolling cutter drill bit having at least one downwardly extending lug member with a rolling cutter rotatably mounted by bearing means on said lug member, said drill bit having a lubricant reservoir formed therein and lubricant passage means therein communicating said reservoir with said bearing means; and further comprising divider means in said passage arranged to form said passage into two separate flow channels, with at least one check valve in at least one of said channels arranged to allow flow therethrough in only one direction, said divider means comprising a relatively thin reed adapted for snugfitting relationship in said passage means spanning said passage means near the central axis thereof, and said check valve comprising an arcuate flexible tang on said reed, projecting downwardly therefrom at an angle of less than about 90 degrees from the plane of said reed and arranged for relatively fluid-tight engagement with the wall of said passage means.

2. The drill bit of claim 1 wherein said divider means further comprises a second reed snugly fitted in said passage means and having valve tang means thereon.

3. The drill bit of claim 1 or claim 2 wherein said divider means further comprises locking means for preventing axial movement of said divider means in said passage means.

4. In a rolling cutter drill bit having a downwardly extending leg with a bearing journal thereon, bearing means on said journal rotatably mounting a rolling cutter, a lubricant reservoir in said leg, a lubricant passage in said leg from said reservoir, and a lubricant passage in said journal from said leg passage and communicating with said bearing means; the improvement comprising;

a passage divider reed in at least one of said passages arranged to form said passage into at least two separate flow channels; and checkvalve means in at least one of said flow channels adapted to provide flow therethrough in one direction only.

5. The drill bit of claim 4 wherein said checkvalve means comprises at least one flexible tang on said reed, projecting downward therefrom, and having a peripheral configuration adapted for relatively fluid-tight engagement with the wall of said lubricant passage.

* * * * *